United States Patent [19]

Reinowitz

[11] 4,363,031

[45] Dec. 7, 1982

[54] WIRELESS ALARM SYSTEM

[76] Inventor: Jack Reinowitz, 563 Union Rd., Spring Valley, N.Y. 10977

[21] Appl. No.: 166,162

[22] Filed: Jul. 7, 1980

[51] Int. Cl.[3] ..... G08B 23/00

[52] U.S. Cl. ..... 340/539; 340/517; 340/628

[58] Field of Search ..... 340/539, 508, 514, 517, 340/521, 577, 584, 628, 629, 630

[56] References Cited

U.S. PATENT DOCUMENTS 3,257,653 6/1966 McCorkindale ..... 340/539

3,909,826 9/1975 Schildmeier et al. ..... 340/539

*Primary Examiner*—Alvin H. Waring

*Attorney, Agent, or Firm*—Philip Furgang

[57] ABSTRACT

A wireless smoke alarm system in which each detector includes a local smoke detector and an alarm. These are coupled to a transmitter and a receiver. The transmitter and receiver are within range of similar units so that an alarm sounded by one unit causes those within range to sound their respective alarms. In sounding their respective alarms, the local units also cause their transmitters to transmit alarm signals thereby overlapping and reinforcing the first unit. A master control is coupled between the alarm detection and local alarm portion and the transceiver to disconnect the unit when the alarm is ended and to transmit a signal to other units, causing each to discontinue their respective alarms.

11 Claims, 2 Drawing Figures

WIRELESS ALARM SYSTEM

BACKGROUND OF THE INVENTION

This invention relates to a system for providing wireless multiple remote detection systems for monitoring the occurrence of a predetermined phenomena and, more particularly to such devices which include wireless transmission and receiving devices as a part thereof.

There have been numerous suggested types of detector devices, amongst them fire or smoke detectors. Such devices typically are powered by a battery or from electrical service and are designed to sound an alarm at the sight of other detection of smoky conditions. In some prior art devices, the detectors are individually connected to a common control station. Upon the occurrence of combustion, a signal is provided at the central station to indicate the location of the detector sensing combustion. In other systems, the detectors are connected in a loop circuit with a control station. Upon one detector sensing combustion, a signal characteristic of that detector, such as a signal of a predetermined frequency, is provided over the loop to the station, so that the location of the detector generating signal may be determined by multiplexing techniques. Such systems are obviously complex.

One problem, however, for detection devices and, in particular, smoke or burglar detection devices for use in the home or in factory locations, is that once the detector becomes enabled, that the warning signals will reach the individual in a remote location. The actual location of the source of the signal is nowhere as important as knowing that a signal has been given.

One suggested device was proposed by Martin et al. in U.S. Pat. No. 4,160,245. Martin et al. proposes a transmitted signal which may be received by a plurality of local receivers. The signal is transmitted by a wireless signal and the local units sound the alarm. A requirement of this system is that the receivers be within receiving distance of the sole transmitter. If the transmitted signal is weak, it may only reach one or none of the receivers, thereby defeating the purpose of the system.

Another suggested approach has been proposed by Siegel et al. in U.S. Pat. No. 4,091,363. Siegel et al. suggests a series of smoke detectors that are hard-wired together, so that a signal initiated by one will set off all other smoke detector units. However, because of the wiring arrangement, if a wire is disconnected, none of the other units will sound. In addition, it is clear that if the battery or the electrical source has been disconnected or reduced in strength in one unit, it may prevent a signal being transmitted to the other units.

Thus, the prior art units previously suggested are either complex in construction, requiring elaborate electrical circuitry or they are merely receivers or transmitters or they are so arranged that a weak signal or a malfunction may interfere with a receipt by the other receiving systems.

SUMMARY OF THE INVENTION

It is an object of this invention to provide a detection system which employs overlapping transceivers, so that the signals of one detector reinforce those of other detectors, thereby insuring an adequate alarm system.

It is a further object of this invention to provide a simple overlapping detection system which may be controlled by means of a master signal.

It is yet another object of this invention to provide an alarm system which is simple in construction, economical in manufacture, and may be easily used.

In accordance with the teachings of this invention, there is provided a detection system of the type intended to detect the occurrence of a local phenomena and transmit at least one signal to other detectors to remotely sound an alarm which comprises a first detector. The first detector includes first means for sensing the occurrence of the predetermined phenomena. There is also provided first means responsive to the sensing means for generating a local alarm to indicate the occurrence of the phenomena. First transmitting means are provided which are electrically coupled and responsive to the first sensing means to wirelessly transmit a first signal indicative of the occurrence of the phenomena. The detection system also comprises a second detector. The second detector comprises second receiving means for receiving the first signal from the first detector. Second means are provided which are electrically coupled and responsive to the second receiving means for generating a local alarm to thereby indicate the occurrence of the phenomena. There is also provided second transmitting means responsive to the first signal for transmitting, by a wireless radio signal, the indication of the occurrence of the phenomena. The detection system also comprises at least a third detector. The third detector comprises a third receiving means for receiving the first signal transmitted by either the first or second transmittings means. There is also provided first means electrically coupled to and responsive to the third receiving means for generating a local alarm for indicating the occurrence of the phenomena.

A BRIEF DESCRIPTION OF THE DRAWING

FIG. 1 is a schematic representation of a detector constructed in accordance with the teachings of this invention; and FIG. 2 is a schematic representation of a plurality of the detectors constructed in accordance with the teachings of this invention.

DESCRIPTION OF THE PREFERRED EMBODIMENT

Figure 1:
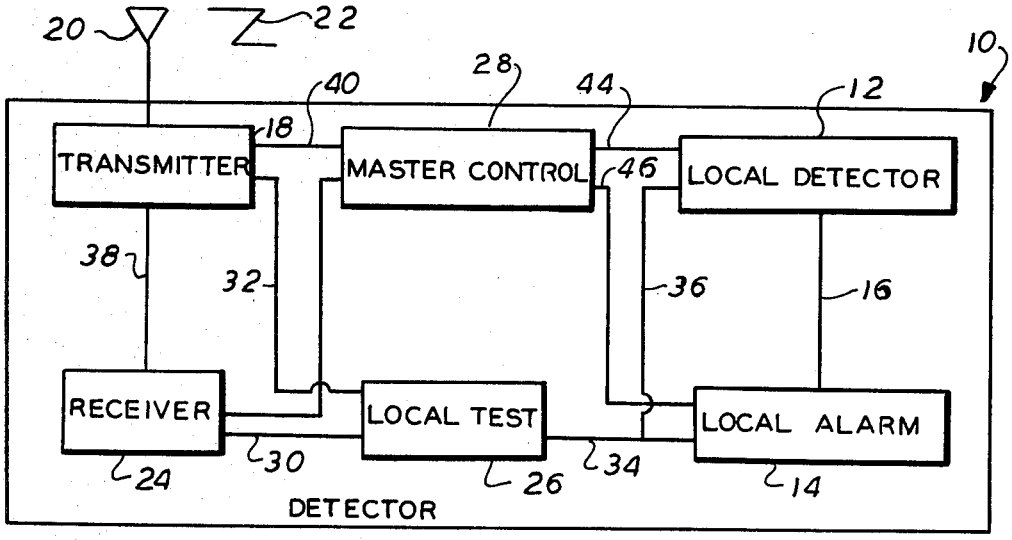

As indicated above, prior art devices included local detectors or devices for detecting the occurrence of an event or phenomena and a transmitter of one form or another for transmitting the signal to receiving devices. These devices were ordinarily linked in such a manner, that if the transmitting device did not provide a sufficiently strong signal, the signal was not transmitted further along the line.

Turning to the drawing, there is provided a detector 10. The detector includes a local phenomena detector 12. The local phenomena detector may be any type such as those that detect gas, smoke, fire, or burglars, as is commonly known in the art.

Figure 2:
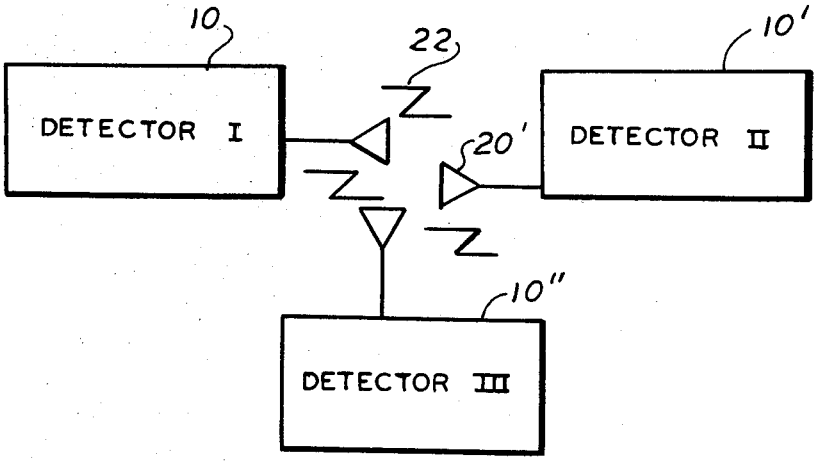

Typically, the local phenomena detector 12 is coupled to a local alarm 14. This connection between the local detector 12 and the alarm 14 is indicated schematically by the line 16. As is well known in the art, the local phenomena detector 12 detecting, for example smoke, causes an electrical signal to be applied to the alarm, thereby sounding the alarm for alerting people thereby. At the same time, the signal issued by the local phenomena detector 12 passes through a master control 28 to a transmitter 18. The transmitter 18 may be of any of a design well known in the art for transmitting a wireless signal over short distances. Such a transmitter may be of the type discussed in the aforementioned patent to Martin et al or in the patent by Goleman, (U.S. Pat. No. 4,091,363) or any other similar device for transmitting over very short distances a signal by way of an antenna 20. The transmitted signal (indicated symbolically at 22) may then be received by a second detector 10' (FIG. 2). The received signal 22 is received by an antenna 20' and to a receiver 24 (FIG. 1). The receiver 24 transmits the received signal through the master control 28 to the local alarm 14, causing the local alarm to sound and at the same time, causes the transmitter 18 of the second detector 10' to transmit a signal indicating that an alarm has been detected.

In operation, three or more such detectors 10, 10', and 10'' may be arranged within the same transmitting range. Assuming that a fire breaks out in the location of detector I 10, it transmits a signal which may be detected by one or both detectors II, III, 10' and 10'', setting both off. In this system, however, it may be that detector III 10'' is out of range of detector I 10 and will only pick up the signal from detector II 10'. In the alternative, it may be that the signal from detector I 10 is within range of detector III 10'', but the signal is so weak that it can only receive the reinforced signal from detector II 10'. In this way, there is an overlapping of the signals of the various detectors (10, 10', 10'') in the system. It will be noted that none of these devices indicate which signal is being transmitted from which detector—merely that an alarm has been sounded—the main purpose for all the detectors. By using wireless transmitters and preferably a battery powered system, it is possible to have an interconnecting system without the expense and inconvenience of hard wiring. Further, by relying on the broadcast range of each of the detectors to overlap, it is not required that each of the detectors be located within range of a particular transmitter. By overlapping the detectors, there is assurance that if a signal from one detector is weak, at least one other will receive it and reinforce that signal.

Each detector 10 may be provided with a local test unit 26. The local test unit 26 may be operated by, for example, a push button (not shown). The test unit 26 disconnects the transmitter 18 and receiver 24 from the system and provides a signal to the local phenomena detector 12, along lines 34 and 36 causing it to cause the local alarm to sound. Local test units 26 are well known and indicate whether the batteries are in proper order and that the local phenomena detector 12 and the alarm system 14 are working. In some devices, the local test device is a light bulb which flickers to indicate that the battery is at a proper level. In the alternative, the local test 26 may allow the transmitter 18 and receiver 24 to operate, thereby testing the entire system.

The unit 26 may also be furnished with the master control 28. The purpose of the master control 28 is to disable the system, once a signal has been given. For the master control 28 to be operative it is necessary that the transmitter 18 transmits two signals. The first signal is received from the antenna 20 along line 38 and after suitable detection may be sent along line 30 and 34 to cause the local phenomena detector 12 and alarm 14 to operate, as has been previously explained. A second signal may be initiated by, for example a push button (not shown) in the master control 28 along line 40 to the transmitter 18 through the antenna 20 to the receiver 24 of another detector. Upon detection by the receiver 24, this signal may be passed via line 42, the master control 28, and lines 44 and 46 to deactivate the local alarm 14. This is merely a schematic representation. One well known method of deactivation is to apply the detected signal to an SCR which is in series with the power supply. There are many such methods however.

When each unit receives the disconnect signal, the master control 28 causes the receiver to transmit a disconnect signal, in the same manner as the transmission of the alarm signal.

Thus, as constructed, the transmitter and receiver preferably have to detect two signals: the first causing the local alarm to sound; the second, from a master control causing the unit to be disabled.

If the phenomena is still present, it is clear that the master control 28 will be ineffective to disable the system. Thus, if someone mistakenly activates a master control 28, thinking the phenomena has passed, the system will continue to operate, thereby further warning the user.

What is claimed is:

1. A detection system of the type intended to detect the occurrence of a local phenomena, and transmit at least one signal to other detectors to remotely sound an alarm, said system comprising:

I. a first detector which comprises:
  a. first means for sensing the occurrence of the predetermined phenomena and generating a signal;
  b. first means responsive to said signal from said first sensing means for generating a local alarm to thereby indicate the occurrence of the phenomena; and
  c. first transmitting means electrically coupled and responsive to said signal from said first sending means to thereby wirelessly transmit a first signal indicative of the predetermined phenomena; and II. at least a second detector which comprises:
  a. second receiving means for receiving said first signal from said first transmitter and generating a signal;
  b. second means responsive to said signal from said second receiving means for generating a separate local alarm to thereby indicate the occurrence of the phenomena; and
  c. second transmitting means, responsive to said signal from said second receiving means, for wireless transmission of said first signal; and III. at least a third detector which comprises:
  a. third receiving means for receiving said first signal from either said first or second transmitting means and generating a signal; and
  b. third means electrically responsive to said signal generated by said third receiving means for generating a separate local alarm to thereby indicate the occurrence of the phenomena.

2. A detection system as recited in claim 1 wherein said third detector further comprises third transmitting means responsive to said first signal to thereby transmit said first signal by wireless transmission.

3. A detection system as recited in claim 2 wherein said first, second and third detectors comprise first, second, and third master control system respectively; said master control system, wherever mentioned, being electrically coupled to said respective transmitter in said detector, wherever mentioned, to be capable to cause said transmitter to transmit a second wireless signal upon the termination of the local phenomena; said receiving means wherever mentioned, upon receiving said second signal, and in combination with said master control electrically coupled thereto, causing said generating means to terminate said local alarm.

4. A detection system as recited in claim 3 wherein said transmitting means, wherever mentioned, comprises a wireless radio transmitter; said receiving means, wherever mentioned, comprises a wireless radio receiver; said generating means, wherever mentioned, comprises an electrically operated local alarm.

5. A detection system as recited in claim 4 wherein said second and third detector further comprise second and third sensing means, each coupled to said respective transmitting means and master control.

6. A detection system as recited in claim 5 wherein said sensing means, wherever mentioned, comprises a smoke detector.

7. A detection system as recited in claim 5 wherein said sensing means, wherever mentioned, comprises a flame detector.

8. A detection system as recited in claim 5 wherein said sensing means, wherever mentioned, comprises a burglar alarm.

9. A detection system as recited in claim 5 wherein said sensing means, wherever mentioned, comprises a gas detector.

10. A detection system as recited in claims 6, 7, 8, or 9 wherein said first, second, and third detectors being battery operated.

11. A detection system as recited in claim 10 wherein said detectors each comprise a local test means for disconnecting said transmitter and receiver from said alarm and sensing means to cause said sensing means to operate to thereby provide a local test that said battery, said sensing means, and said alarm are locally operative.

* * * * *